US008864108B2

(12) United States Patent
James

(10) Patent No.: US 8,864,108 B2
(45) Date of Patent: Oct. 21, 2014

(54) BARRIER SECTION CONNECTION SYSTEM

(75) Inventor: Dallas James, Auckland (NZ)

(73) Assignee: Valmont Highway Technology Limited, Auckland (NZ)

( * ) Notice: Subject to any disclaimer, the term of this patent is extended or adjusted under 35 U.S.C. 154(b) by 60 days.

(21) Appl. No.: 12/602,432

(22) PCT Filed: Jun. 3, 2008

(86) PCT No.: PCT/NZ2008/000129

§ 371 (c)(1),
(2), (4) Date: Mar. 2, 2010

(87) PCT Pub. No.: WO2008/147230

PCT Pub. Date: Dec. 4, 2008

(65) Prior Publication Data

US 2010/0215427 A1 Aug. 26, 2010

(30) Foreign Application Priority Data

Jun. 1, 2007 (NZ) ..... 555598

(51) Int. Cl.
*E04H 17/14* (2006.01)
*E01F 15/08* (2006.01)

(52) U.S. Cl.
CPC ..... *E01F 15/088* (2013.01); *E01F 15/085* (2013.01); *E01F 15/086* (2013.01)
USPC ..... 256/19

(58) Field of Classification Search
USPC ..... 256/13.1, 19, 24–27, 60; 52/590.1, 52/590.2; 404/6, 7, 9, 10; 160/135, 351, 160/229.1, 232, 236; 49/501
See application file for complete search history.

(56) References Cited

U.S. PATENT DOCUMENTS

| | | | | |
|---|---|---|---|---|
| 1,722,994 | A | | 8/1929 | Burd |
| 1,828,349 | A | | 10/1931 | Williams |
| 2,244,042 | A | * | 6/1941 | Barlow ..... 160/229.1 |
| 2,561,206 | A | * | 7/1951 | Kaspar ..... 160/229.1 |
| 2,976,923 | A | * | 3/1961 | Hirashiki ..... 160/229.1 |
| 3,204,606 | A | * | 9/1965 | Parr et al. ..... 119/514 |
| 3,350,039 | A | | 10/1967 | Crater |
| 3,537,687 | A | * | 11/1970 | Adelman ..... 256/19 |
| 3,617,076 | A | | 11/1971 | Attwood et al. |
| 3,738,599 | A | | 6/1973 | Borehag |
| 3,776,520 | A | | 12/1973 | Charles et al. |
| 3,866,397 | A | | 2/1975 | Koziol |

(Continued)

FOREIGN PATENT DOCUMENTS

| | | |
|---|---|---|
| AU | 199674061 | 6/1997 |
| CA | 2167548 | 1/1996 |

(Continued)

*Primary Examiner* — Michael P Ferguson
*Assistant Examiner* — Daniel Wiley
(74) *Attorney, Agent, or Firm* — Greer, Burns & Crain, Ltd.

(57) ABSTRACT

A barrier section which includes at least one connecting assembly at one or both ends of the barrier section, the connecting assembly having: at least one connecting-region which is positioned to be capable of engaging, or being engaged, with at least one connecting-region on an adjacent barrier section, in use; and the at least one connecting-region is configured to selectively engage with at least one connecting-region on an adjacent barrier section via at least one connecting device so the barrier sections have a fixed or pivotable relationship, with one another.

24 Claims, 11 Drawing Sheets

(56) References Cited

U.S. PATENT DOCUMENTS

| | | | | | |
|---|---|---|---|---|---|
| 3,912,404 | A | | 10/1975 | Katt | |
| 3,982,734 | A | | 9/1976 | Walker | |
| 4,047,702 | A | | 9/1977 | Cernia et al. | |
| 4,183,317 | A | | 1/1980 | Follick | |
| 4,222,552 | A | | 9/1980 | Matteo, Sr. | |
| 4,330,106 | A | | 5/1982 | Chisholm | |
| 4,452,431 | A | | 6/1984 | Stephens et al. | |
| 4,498,660 | A | * | 2/1985 | Brema et al. | 256/19 |
| 4,655,434 | A | | 4/1987 | Bronstad | |
| 4,674,911 | A | | 6/1987 | Gertz | |
| 4,678,166 | A | | 7/1987 | Bronstad et al. | |
| 4,681,302 | A | * | 7/1987 | Thompson | 256/13.1 |
| 4,730,810 | A | | 3/1988 | Rambaud | |
| 4,739,971 | A | | 4/1988 | Ruane | |
| 4,844,424 | A | * | 7/1989 | Knudslien | 256/26 |
| 5,022,782 | A | | 6/1991 | Gertz et al. | |
| 5,039,066 | A | | 8/1991 | Stacey | |
| 5,118,056 | A | | 6/1992 | Jeanise | |
| 5,123,773 | A | * | 6/1992 | Yodock | 404/6 |
| 5,207,302 | A | | 5/1993 | Popp et al. | |
| 5,391,016 | A | | 2/1995 | Ivey et al. | |
| 5,609,327 | A | * | 3/1997 | Amidon | 256/24 |
| 5,664,905 | A | | 9/1997 | Thompson et al. | |
| 5,729,607 | A | | 3/1998 | Defries | |
| 5,797,591 | A | | 8/1998 | Krage | |
| 5,820,110 | A | * | 10/1998 | Beu | 256/59 |
| 5,851,005 | A | | 12/1998 | Muller et al. | |
| 5,921,021 | A | * | 7/1999 | Coates | 47/33 |
| 5,967,497 | A | | 10/1999 | Denman | |
| 6,059,491 | A | * | 5/2000 | Striefel et al. | 405/111 |
| 6,065,738 | A | | 5/2000 | Pearce et al. | |
| 6,065,894 | A | | 5/2000 | Wasson et al. | |
| 6,085,458 | A | * | 7/2000 | Gau | 47/33 |
| 6,109,597 | A | | 8/2000 | Sicking et al. | |
| 6,149,134 | A | | 11/2000 | Bank et al. | |
| 6,173,943 | B1 | | 1/2001 | Welch et al. | |
| 6,203,242 | B1 | | 3/2001 | Englund | |
| 6,290,427 | B1 | | 9/2001 | Ochoa | |
| 6,299,141 | B1 | | 10/2001 | Lindsay et al. | |
| 6,398,192 | B1 | | 6/2002 | Albritton | |
| 6,409,417 | B1 | | 6/2002 | Muller et al. | |
| 6,413,009 | B1 | | 7/2002 | Duckett | |
| 6,428,237 | B1 | | 8/2002 | Duckett | |
| 6,474,904 | B1 | | 11/2002 | Duckett et al. | |
| 6,485,224 | B1 | | 11/2002 | Dyke et al. | |
| 6,488,268 | B1 | | 12/2002 | Albritton | |
| 6,558,067 | B2 | | 5/2003 | Ochoa | |
| 6,619,630 | B2 | | 9/2003 | Albritton | |
| 6,676,113 | B2 | | 1/2004 | Christensen et al. | |
| 6,719,483 | B1 | | 4/2004 | Welandsson | |
| 6,729,607 | B2 | | 5/2004 | Alberson et al. | |
| 6,863,264 | B2 | | 3/2005 | Johansson et al. | |
| 6,902,150 | B2 | | 6/2005 | Alberson et al. | |
| 6,926,462 | B1 | | 8/2005 | Fuganti et al. | |
| 6,932,327 | B2 | | 8/2005 | Alberson et al. | |
| 6,948,703 | B2 | | 9/2005 | Alberson et al. | |
| 6,962,328 | B2 | | 11/2005 | Bergendahl | |
| 7,086,805 | B2 | | 8/2006 | Smith et al. | |
| 7,216,854 | B2 | * | 5/2007 | Bryan | 256/25 |
| 7,234,275 | B1 | * | 6/2007 | Haggy et al. | 52/71 |
| 7,396,184 | B2 | | 7/2008 | La Turner et al. | |
| 7,445,402 | B1 | | 11/2008 | Chen | |
| 7,537,411 | B2 | * | 5/2009 | Yodock et al. | 404/6 |
| 7,699,293 | B2 | | 4/2010 | James | |
| 7,722,282 | B2 | * | 5/2010 | Meidan | 404/6 |
| 7,785,031 | B2 | | 8/2010 | Vellozzi et al. | |
| 2001/0013596 | A1 | | 8/2001 | Sicking et al. | |
| 2001/0048846 | A1 | | 12/2001 | Ochoa | |
| 2002/0025221 | A1 | * | 2/2002 | Johnson | 404/6 |
| 2002/0179894 | A1 | | 12/2002 | Albritton | |
| 2003/0219308 | A1 | | 11/2003 | Boulais et al. | |
| 2003/0222254 | A1 | | 12/2003 | Bergendahl | |
| 2004/0140460 | A1 | | 7/2004 | Heimbecker et al. | |
| 2005/0007507 | A1 | | 1/2005 | Ono et al. | |
| 2005/0036832 | A1 | | 2/2005 | Smith et al. | |
| 2005/0047862 | A1 | | 3/2005 | Smith et al. | |
| 2005/0063777 | A1 | | 3/2005 | Smith et al. | |
| 2005/0077507 | A1 | | 4/2005 | Heimbecker et al. | |
| 2005/0077508 | A1 | | 4/2005 | Bronstad | |
| 2006/0013650 | A1 | * | 1/2006 | Meidan | 404/6 |
| 2006/0017048 | A1 | | 1/2006 | Alberson et al. | |
| 2006/0054876 | A1 | | 3/2006 | LaTurner et al. | |
| 2006/0102883 | A1 | | 5/2006 | Troutman et al. | |
| 2007/0102689 | A1 | | 5/2007 | Alberson et al. | |
| 2007/0206990 | A1 | | 9/2007 | Yodock, III et al. | |
| 2007/0252124 | A1 | | 11/2007 | Heimbecker | |
| 2008/0000062 | A1 | | 1/2008 | Boltz | |
| 2009/0146121 | A1 | | 6/2009 | Sharp et al. | |

FOREIGN PATENT DOCUMENTS

| | | | |
|---|---|---|---|
| EP | 0816568 | A2 | 1/1998 |
| EP | 0924348 | | 6/1999 |
| EP | 1152104 | | 11/2001 |
| EP | 1619308 | | 1/2006 |
| EP | 1612333 | | 4/2006 |
| FR | 2701046 | A1 | 8/1994 |
| FR | 2846673 | | 5/2004 |
| NZ | 528396 | | 2/2006 |
| WO | 9629473 | | 9/1996 |
| WO | 9844203 | | 10/1998 |
| WO | 9932728 | | 7/1999 |
| WO | 03064772 | | 8/2003 |
| WO | 2005028757 | | 3/2005 |

* cited by examiner

BARRIER SECTION CONNECTION SYSTEM

STATEMENT OF CORRESPONDING APPLICATIONS

This application is based on the provisional specification filed in relation to New Zealand Patent Application Number 555598, the entire contents of which are incorporated herein by reference.

TECHNICAL FIELD

The invention relates to an improved barrier section. In particular, the present invention relates to improved barrier section and connection system between two or more barrier sections. The connection system allows the barrier sections to be aligned and retained in at least two different configurations when forming the barrier.

BACKGROUND ART

There are a number of different types of permanent and temporary barriers. These barriers are used in a number of applications where it is necessary to separate one area from another. Examples of the types of applications barriers may be used include, dividing road lanes, construction sites or other hazardous areas.

Barriers are typically constructed by connecting a plurality of barrier sections together. Barriers are positioned to fit various configurations and may be connected to that the barrier is made up of various barrier sections. Prior art barrier sections are generally connected together either by a single pin which allows the barrier sections to pivot with respect to each other and not fix in place. Alternatively, the barrier sections are connected by a series of four pins that fix the barrier sections in place and do not allow for any movement or pivoting between the sections.

For example one type of barrier connection employs a hinging mechanism, with two parallel sets of projections located on each end of each barrier section. The first set of projections on one end forms the gudgeon portion of the hinge mechanism, while the second set of projections on the opposing end forms the pintle portion of the hinge. To connect these barrier sections together, both pintle portions on one barrier section is slotted into both gudgeon portions of another barrier section thereby forming the hinge. One disadvantage of this system is the time taken to form this connection increases substantially when further barrier sections have already been connected together, as the user has to ensure that downstream barrier connections do not come apart when the section being worked on is lifted into place. Additionally, as there is no locking or fastening mechanism in this connection, these types of barriers are generally only suitable for flat terrain. Uneven terrain does not allow the projections to properly align and connect together. A further disadvantage is that as sections are not locked together, this allows the sections to hinge and easily pivot with respect to each other, therefore offering little structural resistance to an impact force such as from a vehicle impact.

New Zealand Patent No. 511631 describes another barrier connection system, where a plurality of barrier sections is connected together through a variation on a hinging mechanism. Here, each barrier section has a plate that protrudes from the centre of each end on the section. Each plate has two projections and when the barrier sections are connected, the two projections overlap the two projections on the other barrier section. A single hinge pin is then threaded through an aperture which runs through all four projections to connect the barrier sections together.

Another barrier connection system is also detailed in New Zealand Patent No. 524878. The connection device described in this patent also uses hinge elements or brackets to connect a number of barrier sections together. Similar to NZ 511631, this system has a hinge element located on each end of the barrier section. The hinge element is constructed from two brackets that project out and extend the whole width of the end of the barrier section. When in use, the brackets from two barrier sections overlap each other and are attached by a series of pins or bolts. The bins connect the brackets at three different connection points. One connection point is located in the centre of the bracket, while the other two connection points are at either end of the bracket or side the barrier section.

One problem with the connections described in NZ 511631 and NZ 524878 is that it is difficult to move a barrier section into a different orientation to the other sections. The hinging mechanisms can not be easily re-positioned from the initial arrangement. To re-orientate the barrier sections, the hinges that have to be loosened, the barrier section moved to the desired angle and the hinges tightened. This can be time consuming and labour intensive, as numerous parts have to be manipulated.

Another disadvantage is that the hinging connections are constructed from metal. As some temporary barrier sections are often filled with fluid for weight when in place, the metal components have to be regularly inspected for wear and tear and to ensure that the systems remain safe and effective. Also to avoid corrosion, the metal needs to be resistant to corrosion and hence tends to add expense to the barrier cost. Further, as the hinge elements or brackets project out from the end of the barrier section, this may be a potential hazard particularly if the barrier is struck by an impacting vehicle, as substantial damage may be caused to the vehicle and/or passages.

It therefore would be an advantage to have a connection system that would allow at least two barrier sections to run in varying orientations with respect to each barrier section and allow the direction to be easily manipulated. It would also be useful to have a system that has few metal hinging parts or elements that did not have to be routinely checked to ensure safety standards are met. Further, it would be useful to have a barrier connection that would fasten and hold the sections together, therefore allowing the barrier to be constructed and be suitable for a number of different terrains along with provide sufficient support if impacted by a vehicle.

It is an object of the present invention to address the foregoing problems or at least to provide the public with a useful choice.

All references, including any patents or patent applications cited in this specification are hereby incorporated by reference. No admission is made that any reference constitutes prior art. The discussion of the references states what their authors assert, and the applicants reserve the right to challenge the accuracy and pertinency of the cited documents. It will be clearly understood that, although a number of prior art publications are referred to herein; this reference does not constitute an admission that any of these documents form part of the common general knowledge in the art, in New Zealand or in any other country.

It is acknowledged that the term 'comprise' may, under varying jurisdictions, be attributed with either an exclusive or an inclusive meaning. For the purpose of this specification, and unless otherwise noted, the term 'comprise' shall have an inclusive meaning—i.e. that it will be taken to mean an inclusion of not only the listed components it directly references, but also other non-specified components or elements. This rationale will also be used when the term 'comprised' or 'comprising' is used in relation to one or more steps in a method or process.

Further aspects and advantages of the present invention will become apparent from the ensuing description which is given by way of example only.

DISCLOSURE OF INVENTION

According to one aspect of the present invention there is provided a barrier section which includes at least one connecting assembly at one or both ends of the barrier section, the connecting assembly having:

connecting-region(s) which are positioned to be capable of engaging, or being engaged, with connecting-region(s) on an adjacent section, in use;

the barrier section characterized in that the connecting-region (s) are configured to engage with the connecting-region(s) on an adjacent section via at least one connecting device so that the barrier sections have either: a fixed, or pivotable relationship, with one another.

Preferably, a fixed relationship has the respective connecting-regions engaged in an in-line configuration; and wherein a pivotable relationship has the connecting-region(s) engaged in an angled configuration. In general, the connecting-region (s) on the barrier sections may consist of at least one projection portion, and at least one receiving portion; at either end thereof.

In an alternative embodiment, both the first and second ends of a barrier section may have projecting portion(s) or receiving portion(s).

For ease of reference only the connecting-region(s) will now be referred to as being projecting portion(s) and receiving portion(s).

According to another aspect of the present invention there is provided a barrier comprising two or more barrier sections including a connection which are connected via a connecting-region between adjacent barrier sections, wherein the connecting-region include(s):

(a) at least one projecting portion at one distal end of the first barrier section;

(b) at least one receiving portion at an opposing second distal end of the second barrier section;

(c) a connecting device; and, characterised in that the connecting device retains the projecting portion(s) of the first barrier section and the receiving portion(s) of the second barrier section such that the barrier sections are in a fixed relationship with respect to each other; and, the connecting device may be readjusted to connect the first and second barrier section in a pivotable relationship with respect to each other.

Preferably, an in-line configuration has the respective connecting-region(s) engaged in a fixed relationship; and wherein an angled configuration has the connecting section (s) engaged in a pivotable relationship.

The inventors of the present invention have developed an improved barrier section connection system for selectively engaging and connecting two or more barrier sections together in a number of configurations. Preferably, this connection system allows the barrier sections to be positioned in an in-line configuration or positioned in an angled configuration.

It should be appreciated that the barrier sections may be constructed from a range of materials. Preferably, the barrier may be moulded and/or constructed from a suitable type plastic, such as polyethylene. In alternative embodiments, the barrier may be constructed from a suitable metal, such as steel.

In some preferred embodiments the barrier section may include a hollow portion which may be filled with a liquid or other material, to add weight to the barrier section. It should be appreciated that by having hollow barrier sections this provides for ease of transport and assembly. Preferably the barrier sections may be filled with a fluid, such as water after connection via the connection device of the present invention. Use of water (or other fluids) in the barrier sections provides greater weight to further support the barrier sections in position.

Preferably, the projecting portions(s) and receiving portions(s) may be integral with the body of the barrier section.

More preferably, the projecting portion(s) and receiving portion(s) may be made of substantially the same material as the barrier section.

It should be appreciated that the projection portions(s) and receiving portion(s) may have numerous variations in shape and configuration. In general, the projection portions(s) and receiving portion(s) should complement each other and thereby easily fit together.

Preferably, the projection(s) may be at least one protrusion. Preferably, in embodiments where there may be one protrusion, the protrusion may be substantially centrally positioned. In embodiments where there may be three or more protrusions, the protrusions may be evenly spaced with respect to one another.

Preferably, the receiving portion(s) may be at least one recess.

Most preferably the recess may be in the form of a notch.

Preferably, the dimensions of the recess may be sufficient to receive the protrusion and provide enough space for the connection to be effected even when the respective sections are on uneven ground contours.

In other embodiments the connection-region(s) are in the form of projecting portions.

The barrier section(s) are capable of being engaged together by a connecting device which forms part of the connection assembly. In preferred embodiments, the projection portion(s) and/or receiving portion(s) each have at least two apertures that pass through the projection portion(s) and/or receiving portion(s) that allow the connection, device to pass through the apertures once aligned, and engage the barrier sections to one another.

Preferably, the connection device passes through the aligned apertures to engage the barrier sections and connect and retain the barrier sections in place.

The connecting-regions may be configured in a variety of different ways to have either a fixed or pivotable relationship.

In preferred embodiments where the connecting-regions are in the form of receiving and projection portions the respective portions may each include two apertures which are spaced apart and positioned to be capable of aligning with the respective aperture on the other portion.

In a preferred embodiment, at least two apertures may pass through the projecting portion(s) and/or the receiving portion (s). Preferably, the apertures may be orientated parallel to each other through the projecting portion(s) and/or receiving portion(s). In alternative embodiments, the apertures may run horizontally through the projecting portion(s) and/or receiving portion(s). Preferably, a first or outer aperture may be positioned close to the distal end of the barrier section and a second or inner aperture may run inside the first aperture, closer to the centre of the barrier section.

In preferred embodiments where the receiving portion is at least one notch at one end of the barrier section the aperture(s) may travel sub vertically from the top of the barrier section to the notch and through to the bottom or bottom region of the barrier section.

When both apertures on each of the respective receiving portion(s) and projecting portion(s) are aligned this is the configuration which allows for a fixed relationship between the sections.

Alternatively, when only the outermost apertures on the respective receiving portion(s) and projecting portion(s) are aligned this is the configuration which allows for a pivotable relationship between the sections.

In some embodiments the connecting device may be at least one pin or such like.

In preferred embodiments, the connecting device may have least two shafts aligned in the same plane, wherein the shafts are adapted to be received through the apertures.

Preferably, the connecting device may be at least one U-shaped staple.

It will be appreciated that the connecting device that engages the barrier sections together provides support and strength to assist in retaining the barrier sections in the required position.

In the fixed position wherein the barrier sections may be positioned in line with respect to each other, the connecting device(s) pass(es) through both apertures in the respective receiving portion(s) and projecting portion(s).

In the pivotable position wherein the barrier sections may be positioned at a desired angle with respect to each other, the connecting device only passes through the outermost aperture in the respective receiving portion(s) and connecting portion (s).

Preferably, in the pivotable relationship the barrier sections may be positioned at an angle of up to 30° with respect to each other (i.e. 30° from an in-line configuration).

More preferably, the angle between the barrier sections may be between 7.5° to 15° from an in-line configuration.

According to another aspect of the present invention, there is a method of constructing a barrier by the steps of:

(a) selecting two or more barrier sections; and (b) connecting the barrier sections so that they are engaged to one another in either a fixed or a pivotable manner.

It will be appreciated that steps (a) to (b) may be repeated with a multiple number of barrier sections until the desired barrier length is achieved.

According to another aspect of the present invention, there is a barrier constructed from two or more barrier sections substantially as described above.

According to a further aspect of the present invention there is provided a connection between barrier sections, wherein the connection includes:

(a) at least one projecting portion at one distal end of the first barrier section;

(b) at least one receiving portion at an opposing second distal end of the second barrier section;

(c) a connecting device; and, characterized in that the connecting device retains the projecting portion or portions of the first barrier section and the receiving portion or portions of the second barrier section such that the barrier sections are aligned in a first in-line position with respect to each other; and, the connecting device may be readjusted to connect the first and second barrier section in a second angled position with respect to each other.

It may be appreciated from the above description that an advantage of the use of the connecting device to engage the barrier sections is that it is more tolerant of uneven ground or terrain changes than at least some prior art designs. This is because connecting device is: sufficiently robust; and is dimensioned to be suitably sized with the apertures to provide room for non-perfectly aligned apertures as occurs on uneven ground to allow for changes in barrier sections angle.

The inventors have found that one advantage of the present invention is that the configuration of the connection device allows the connection between two barrier sections to be placed in one position without altering the position of the downstream barrier connections. In prior art embodiments, re-positioning a joint between two barrier sections may result in other barrier sections also needing to be re-positioned or even resulting in other barrier sections falling apart and needing to be reassembled. A further advantage is that this connection provides support and stability to the barrier sections of the present invention in the event of a side on impact such as may occur in traffic applications.

Preferred embodiments of the present invention can have a number of advantages over the prior art which include providing a connection between at least two barrier sections to allow the sections to be retained fixed in either an in-line or at angled configuration. The present invention allows for simple readjustment to allow barrier sections to be re-configured in an angled position relative to each other. Further advantages include:

having a connection section(s) having few metal parts or elements that do not have to be checked for wear and tear;

a barrier connection assembly that can fasten and hold the sections together on uneven or sloped ground, therefore allowing the barrier to be constructed and be suitable for a number of different terrains; and providing sufficient support between barrier sections so that upon impact, the connection device retains the relative position of the barrier sections.

BRIEF DESCRIPTION OF DRAWINGS

Further aspects of the present invention will become apparent from the following description which is given by way of example only and with reference to the accompanying drawings in which:

FIG. 5 shows a perspective view of a projecting portion of one barrier section; where;

FIG. 6 shows a perspective view of a receiving portion of one barrier section; where;

BEST MODES FOR CARRYING OUT THE INVENTION

Figure 1:
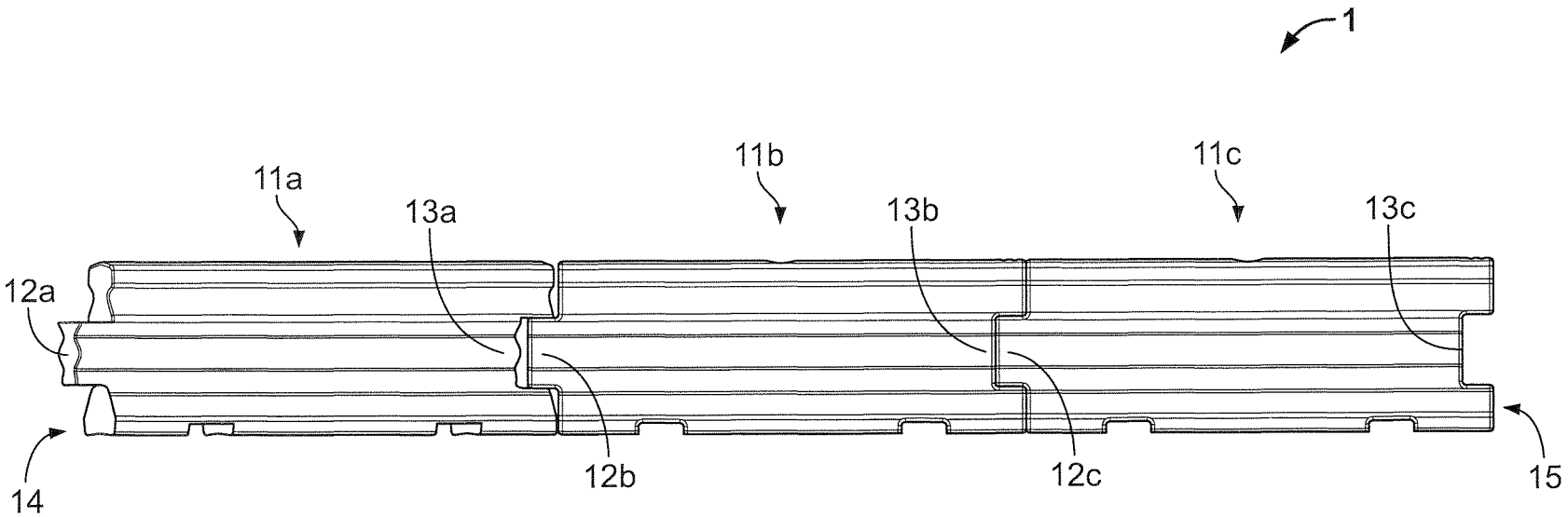
FIG. 1 shows a side elevation of a barrier constructed from three barrier sections, wherein two ends two of barrier sections are orientated in a second position and two ends of a further two barrier sections are orientated in a first position.
Figure 2:
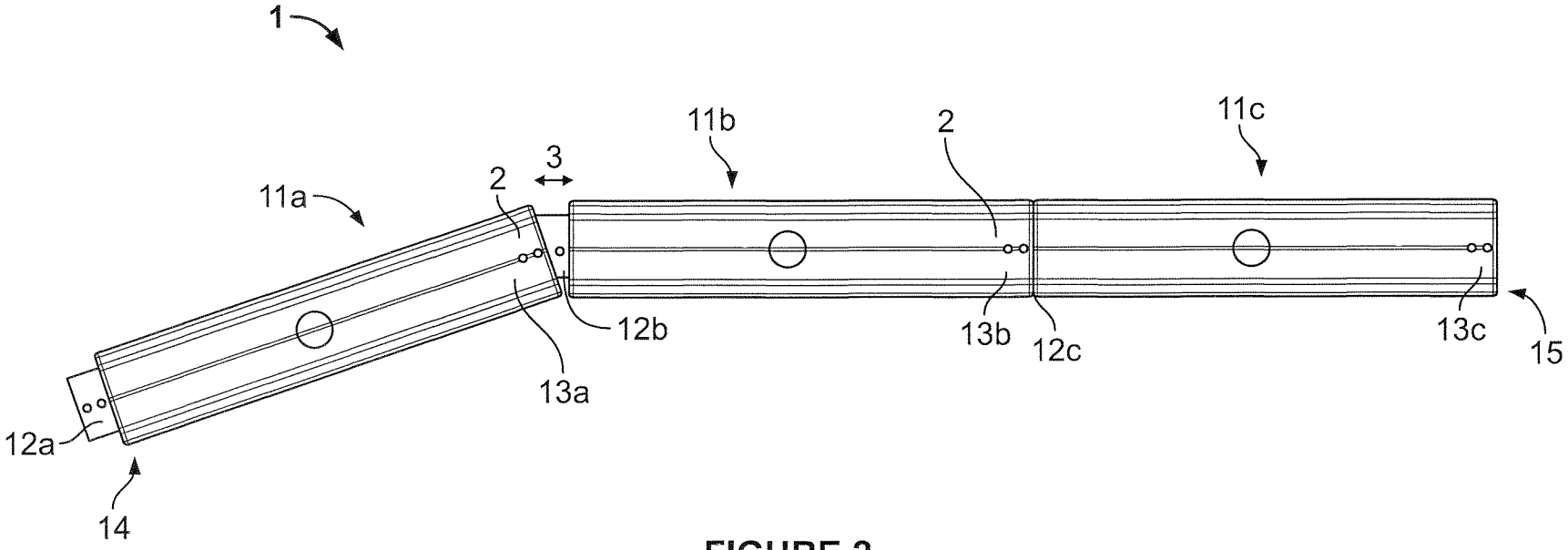
FIG. 2 shows a plan elevation of a barrier constructed from three barrier sections, wherein two ends two of barrier sections are orientated in a second position and two ends of a further two barrier sections are orientated in a first position.
Figure 9:
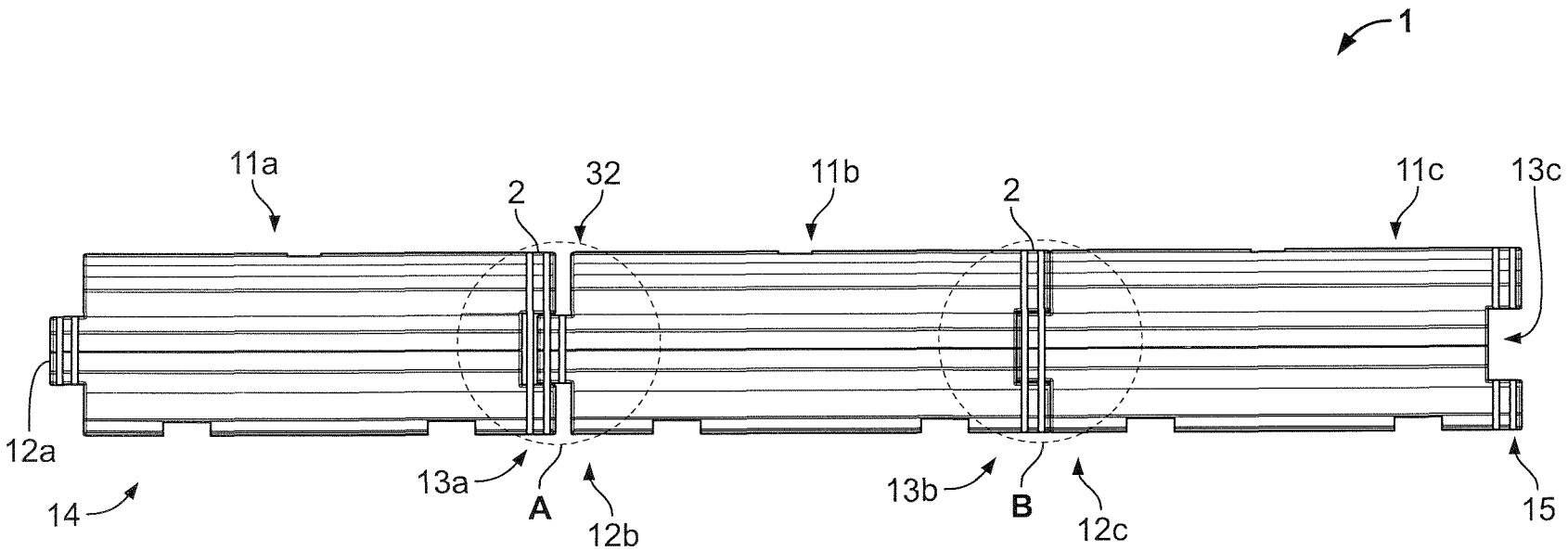
FIG. 9 shows a cross section side view of a barrier constructed from three barrier sections, wherein the ends two of barrier sections are orientated in a second position and the ends two of barrier sections are orientated in a first position.

FIGS. 1, 2 and 9 show a barrier 1. The barrier 1 is constructed from three barrier sections, as indicated by arrows 11*a* to 11*c* respectively. In FIG. 2 the two ends of the barrier sections 11*a* and 11*b* are orientated in a second position, while two ends of the barrier sections 11*b* and 11*c* are orientated in a first position. When the barrier sections are orientated in a first position, (for example, the barrier sections 11*b* and 11*c*) the barrier sections are positioned in an in-line position with respect to each other. In comparison, when the barrier sections are orientated in a second position, one barrier section 11*a*, is positioned in an angled position with respect to the second barrier section 11*b*.

Figure 3:
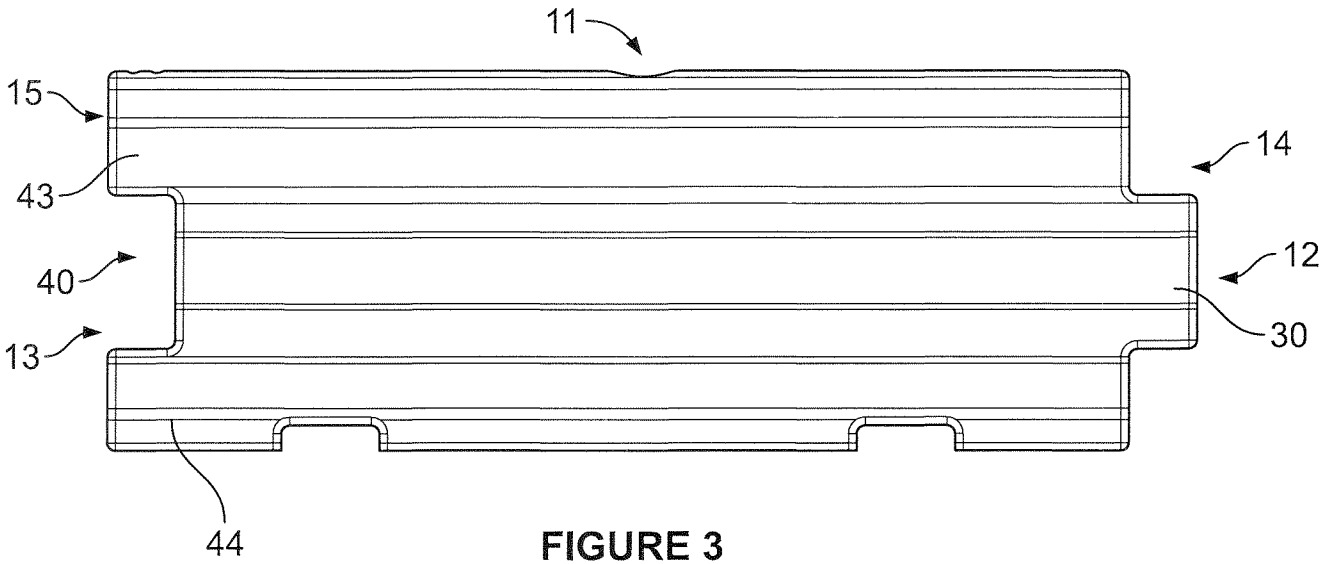
FIG. 3 show a side view of a single barrier section.
Figure 4:
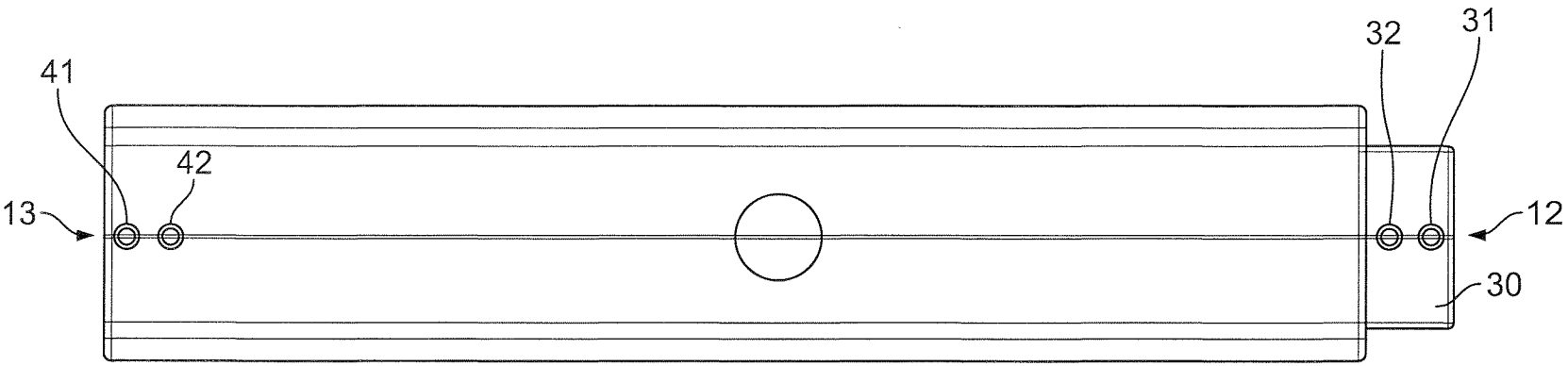
FIG. 4 show a plan view of a single barrier section.

FIGS. 3 and 4 respectively show a side view and plan view of a single barrier section 11. As shown, the barrier section 11 has a projection 12 in the form of a single protrusion 30 at one end 14 of the barrier section 11. Additionally, the barrier section 11 has a receiving portion 13 in the form of a single recess 40 with two sides 43 and 44 at the opposing end 15. As shown on FIG. 4, protrusion 30 has two apertures 31 and 32 that pass vertically though the barrier section 11 and the recessed sides 43 and 44 have two apertures 41 and 42 which also pass substantially vertically though each recessed side 43 and 44.

Figure 5B:
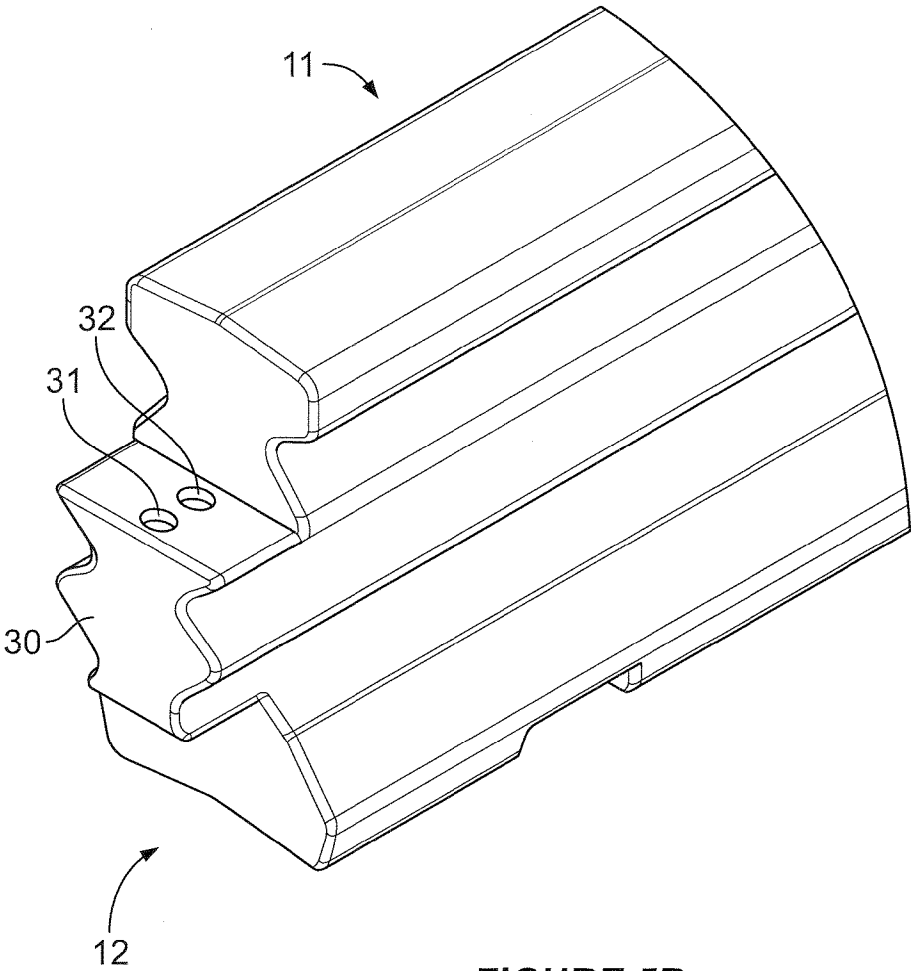
FIG. 5*b* shows a further partial perspective view of the projecting portion of one barrier section as indicated in FIG. 5*a;*
Figure 5A:
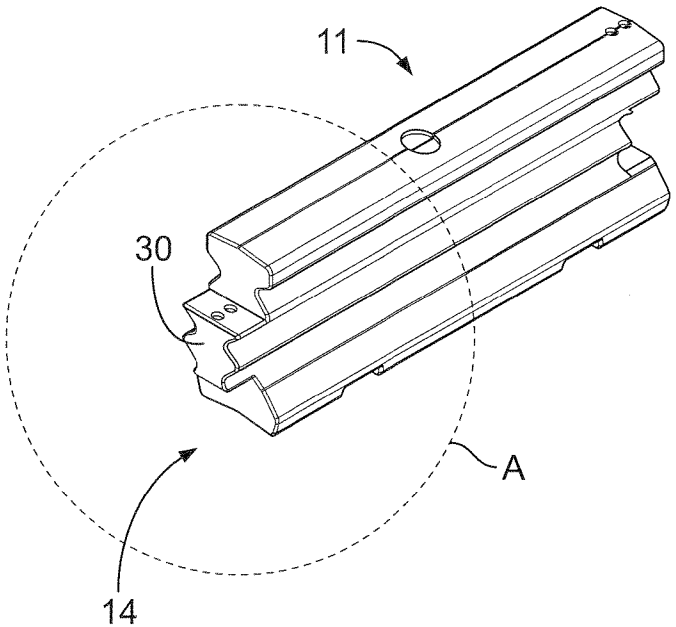
FIG. 5*a* shows a perspective view of a projecting portion of one barrier section in accordance with the present invention.

The projection 12 is further shown in FIGS. 5*a* and 5*b*. FIG. 5*a* shows one preferred location of the projection 12 with respect to one end 14 of the barrier section 11. FIG. 5*b* shows an expanded view of the projection 12, as indicated by Circle A on FIG. 5*a*. In this embodiment, the projection 12 is in the form of a single protrusion 30. The protrusion 30 has two apertures 31 and 32 that pass vertically though the barrier section 11.

Figure 6B:
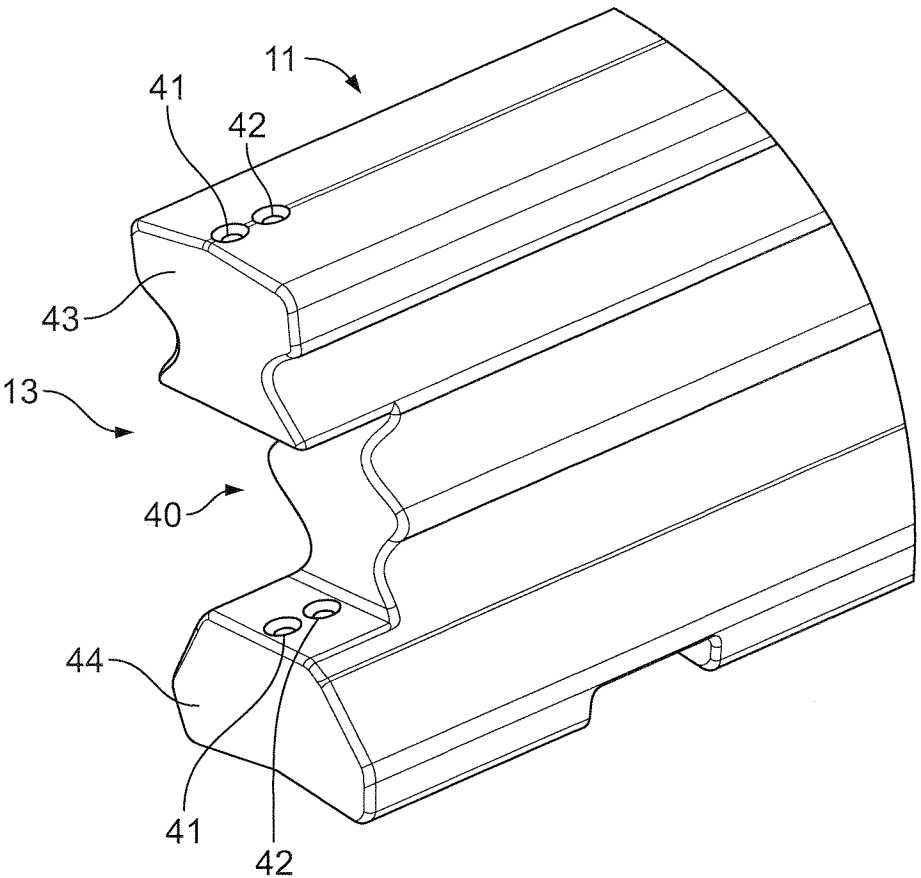
FIG. 6*b* shows a further partial perspective view of the receiving portion of one barrier section as indicated in FIG. 6*a;*
Figure 6A:
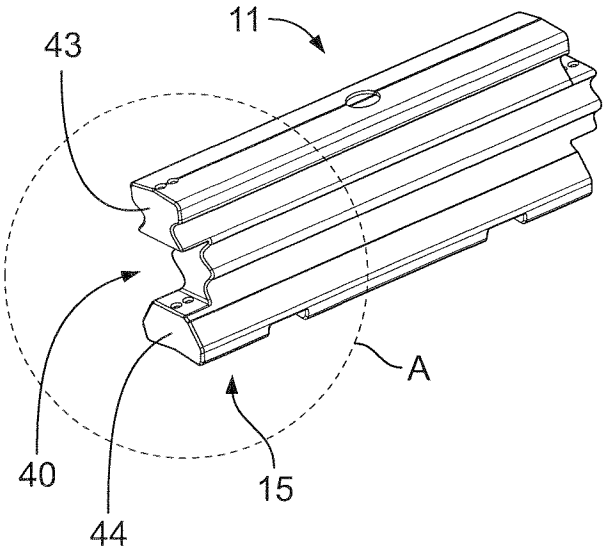
FIG. 6*a* shows a perspective view of a receiving portion of one barrier section in accordance with the present invention.

FIGS. 6*a* and 6*b* show a preferred embodiment of a receiving portion 13. FIG. 4*a* shows one preferred location of the receiving portion 13 with respect to one end 15 of the barrier section 11. FIG. 6*b* shows an expanded view of the receiving portion 13, as indicated by Circle A on FIG. 6*a*. In FIGS. 6*a* and 6*b*, the receiving portion 13 is a recess 40. The recess 40 has two sides 43 and 44. Each recess side 43 and 44 has two apertures 41 and 42 which pass substantially vertically though each recess sides 43 and 44.

Figure 7:
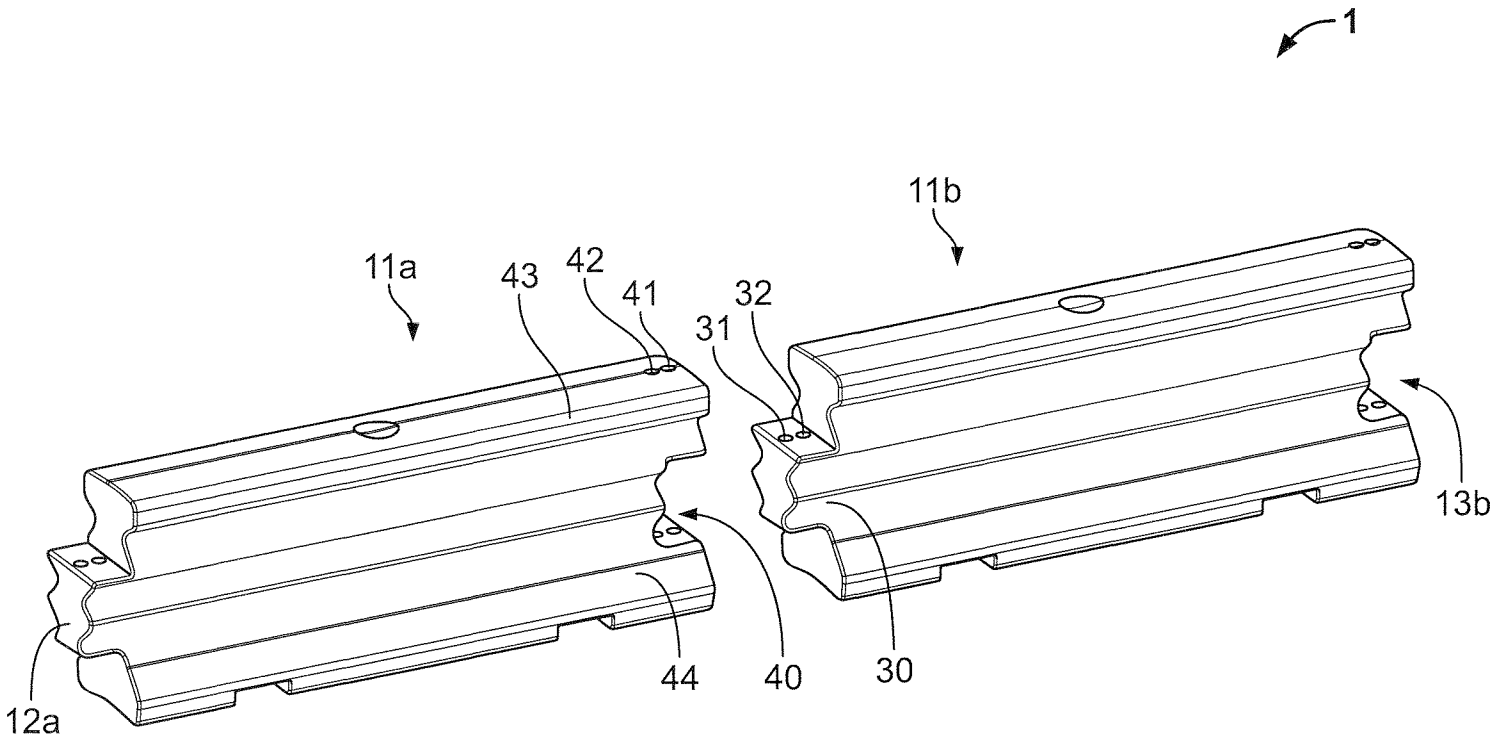
FIG. 7 shows a perspective exploded view of one preferred embodiment of the present invention, wherein the barrier sections are prior to be connected in a first position.

FIG. 7 shows two barrier sections 11*a* and 11*b* with the respective recess 40 of the receiving portion and the protrusion 30 of the projection are orientated in a position prior to barrier sections 11*a* and 11*b* being connected together in a second position.

Figure 8:
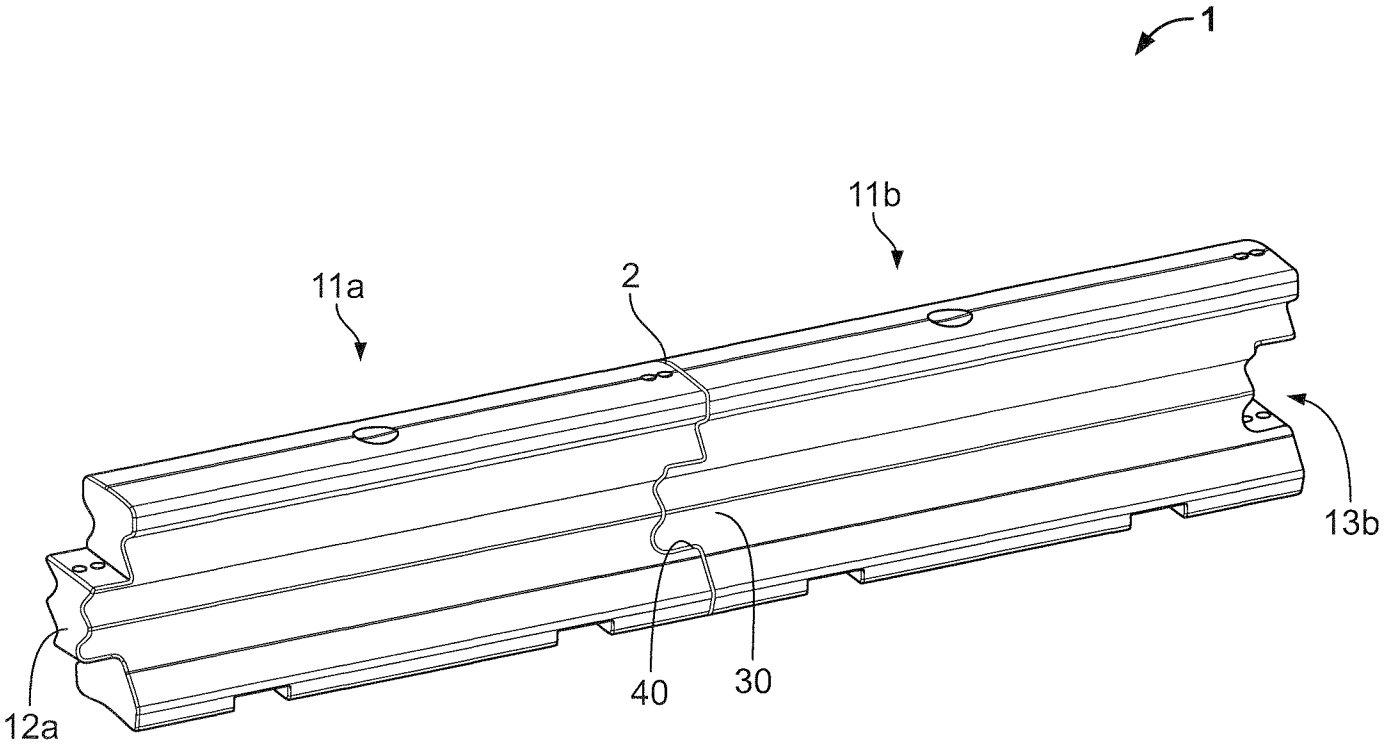
FIG. 8 shows a perspective view of one preferred embodiment of the invention, in a first position in accordance with the present invention.

FIG. 8 shows the respective recess 40 of barrier section 11*a* and the protrusion 30 of barrier section 11*b* connected together in a second position by a connection device in the form of a staple 2.

FIG. 9 shows a cross sectional view of a barrier 1 constructed from three barrier sections 11*a* to 11*c*. The two ends, of the barrier sections 11*a* and 11*b* are orientated in a second position, while the two ends of the barrier sections 11*b* and 11*c* are orientated in a first position.

Figure 10:
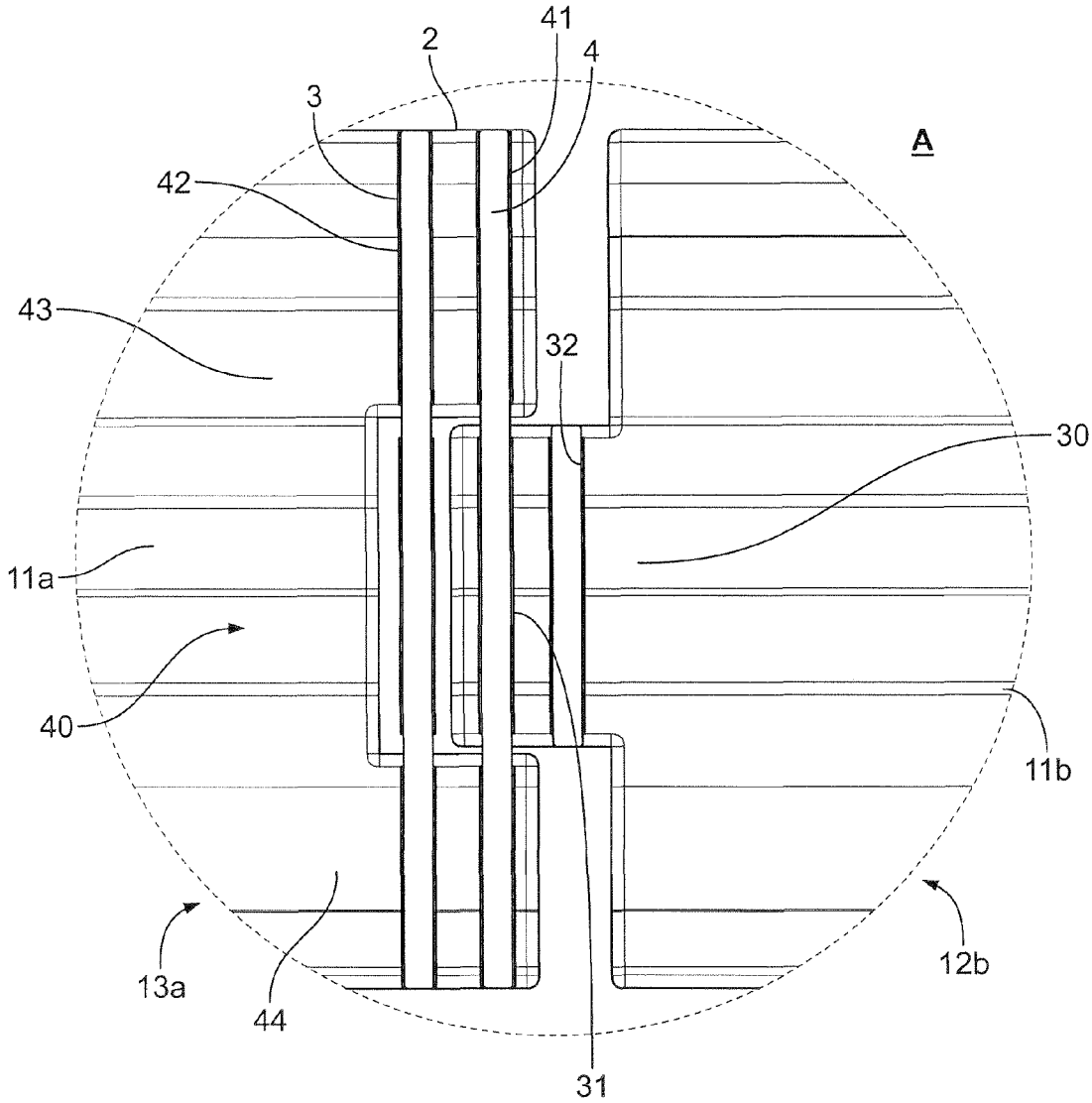
FIG. 10 shows a partial cross section view of barrier sections are retained second position.
Figure 11:
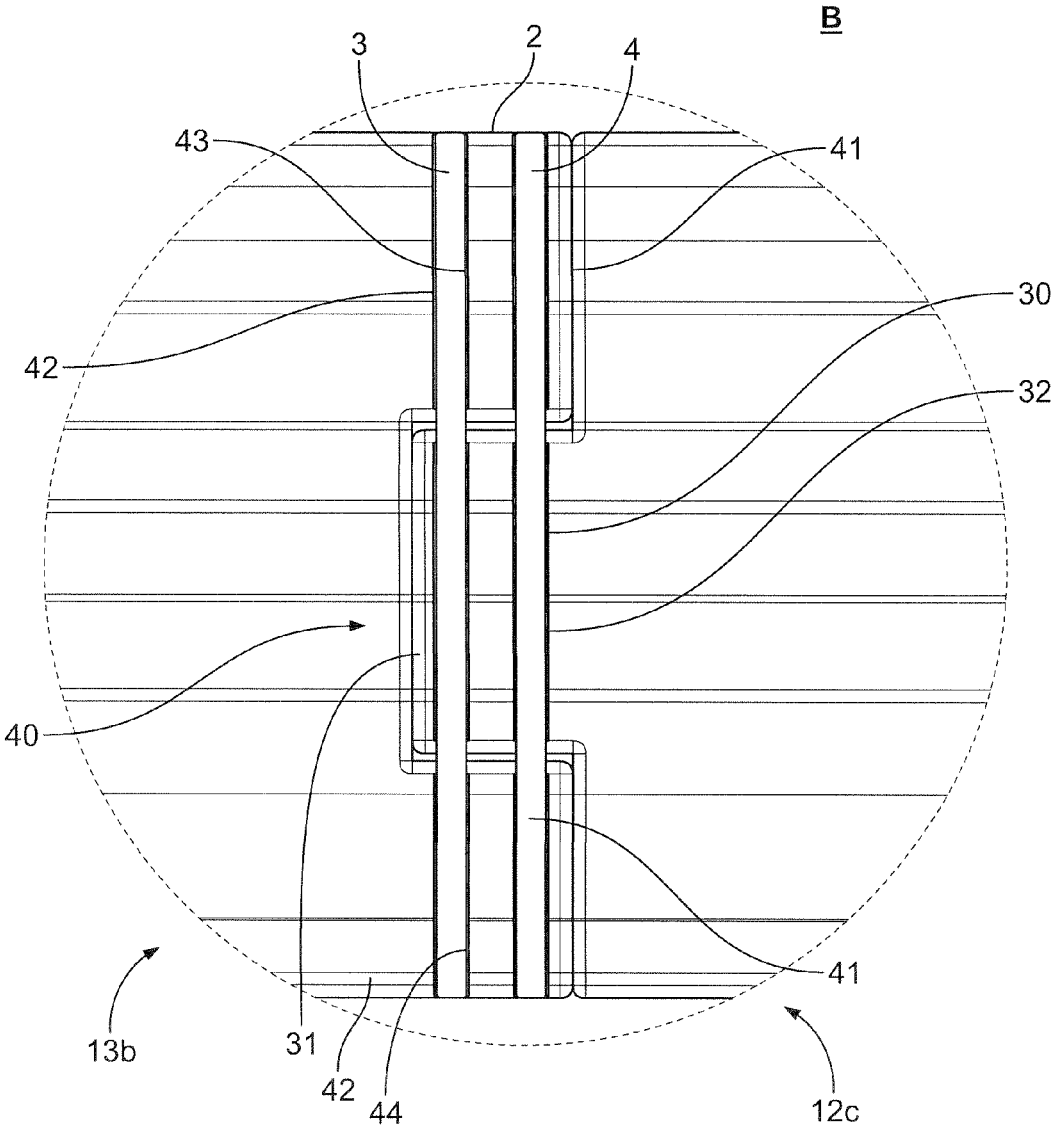
FIG. 11 shows a partial cross section view of barrier sections are retained first position.

FIGS. 10 and 11 show close up cross sectional views of the barrier sections orientated in the second and first positions respectively. FIG. 10 is a close up of the view of the connection between the barrier sections 11*a* and 11*b* as indicated by Circle A on FIG. 9. In comparison, FIG. 11 is a close up of the view of the connection between the barrier sections 11*b* and 11*c* as indicated by Circle B on FIG. 9.

FIG. 10 shows the projection 12*b* with respect to one end 14 of the barrier section 11*b*. The projection 12*b* is in the form of a single protrusion 30 with two apertures 31 and 32 that pass vertically though the barrier section 11*b*. FIG. 10 also shows the receiving portion 13*a* with respect to one end 15 of the barrier section 11*a*. The receiving portion 13*a* is in the form of a recess 40 with two sides 43 and 44 and with two apertures 41 and 42 which pass substantially vertical though each recess side 43 and 44.

FIG. 10 shows the two ends the barrier sections 11*a* and 11*b* are aligned in a second position. Here, protrusion 30 from barrier section 11*b* is connected with the recess 40 of barrier section 11*a*. In this Figure, barrier section 11*a* is positioned in the desired angle, with respect to the end 15 of the second barrier section 11*b*. To connect the barrier sections 11*a* and 11*b* together aperture 31 on the protrusion 30 and aperture 42 on recess sides 43 and 44 are aligned. A staple 2 with two shafts 3 and 4 has then been threaded through the apertures to retain the barrier sections 11*a* and 11*b* in position. As shown, shaft 4 of staple 2 is threaded through the apertures 31 and 42, while shaft 3 of the staple 2 is threaded through the aperture 42.

In comparison, FIG. 11 shows the projection 12*c* with respect to one end 14 of the barrier section 11*c*. The projection 12*c* is in the form of a single protrusion 30 with two apertures 31 and 32 that pass vertically though the barrier section 11*c*. Also shown, is a receiving portion 13*b* with respect to one end 15 of the barrier section 11*b*. The receiving portion 13*b* is in the form of a recess 40 with two sides 43 and 44 and with two apertures 41 and 42 which pass substantially vertically though each recess side 43 and 44.

FIG. 11 shows two ends of the barrier sections 11*b* and 11*c* are retained in a first in-line position, with respect to each other. Protrusion 30 from barrier section 11*c* is connected with the recess 40 of barrier section 11*b*, apertures 42 and 31 and apertures 41 and 32 are aligned. The two shafts 3 and 4 of the staple 2 are threaded through both aperture combinations. One shaft 4 of pin 2 is threaded through the first aperture combination 41 and 32, while shaft 3 of the pin 2 is threaded through the second aperture combination 42 and 31.

To construct the barrier sections 11*a* to 11*c* in a first position (for example, the barrier sections 11*b* and 11*c* shown in FIGS. 1 and 2), the receiving portion 13*b* on one end 15 of the first barrier section 11*b* and the projection 12*c* of a second barrier section 11*c* are connected together. Both sets of apertures on the receiving portion 13*b* and the projection portion 12*c* are lined up (for example respective apertures 42 and 31 are lined up and apertures 41 and 32 are lined up). The shafts 3 and 4 of the staple 2 are then threaded through the apertures. Specifically, one shaft 4 of the staple 2 is threaded through the first aperture combination (apertures 41 and 32), while the other shaft 3 of the staple 2 is threaded through the second aperture combination (apertures 42 and 31). FIGS. 9 and 11 also show respective barrier sections constructed in a first position.

To construct the barrier sections in a second position (for example, the barrier sections 11*a* and 11*b* shown in FIGS. 1 and 2), the receiving portion 13*a* of the first end 15 of the first barrier section 11*a* is connected with the projection 12*b* of a second barrier section 11*b*. Respective apertures 31 and 41 are lined up and one shaft 4 of staple 2 is then threaded through the apertures 31 and 41 to retain the barrier sections 11*a* and 11*b* in position. The other shaft 3 of the staple 2 is threaded through the aperture 42. This allows the barrier sections to then be positioned in the desired position or angle with respect to each other. FIGS. 9 and 10 also show respective barrier sections constructed in a second position.

It should be appreciated from the above examples that there is provided an improved barrier connection system that allows at least two barrier sections to allow the sections to be retained or fixed in an in-line configuration. The connection device also allows for simple readjustment to allow barrier sections to be re-configured in an angled position relative to each other. Additionally, the preferred embodiments of the present invention provide a system with few metal hinging parts or elements. This system also provides sufficient support if subjected to a side impact such as if struck by a vehicle.

Aspects of the present invention have been described by way of example only and it should be appreciated that modifications and additions may be made thereto without departing from the scope thereof as defined in the appended claims.

What I claim is:

1. A vehicle impact barrier comprising at least first and second longitudinally extending barrier sections, each barrier section including a base of sufficient width for the barrier section to be freestanding, the first barrier section-including a first connecting assembly at one or both ends thereof, the second barrier section including a second connecting assembly at one or both ends thereof, the first and second connecting assemblies each comprising at least a first and second connecting-region, respectively;

wherein the first connecting-region is positioned for engagement with the second connecting-region, each connecting-region having longitudinally-spaced inner and outer holes extending therethrough;

the first connecting-region being configured to engage with the second connecting-region via a two-pronged connecting device, each prong being insertable vertically through one of said inner and outer holes of said first and second connecting-regions, wherein the first connecting-region is movable longitudinally between a first position and a second position relative to the second connecting-region, wherein in said first position:

the inner and outer holes of said first connecting region are aligned with the outer and inner holes of said second connecting region, respectively, and the connecting device is connected through both sets of inner and outer holes such that the first and second connecting-regions are interlocked and non-pivotable relative to each other; and side surfaces of said barrier sections are substantially coplanar, and wherein in said second position:

an end face of the first connecting-region and a contact face of the second barrier section are longitudinally displaced from each other;

the outer holes are aligned and the connecting device is inserted with one prong extending through the aligned outer holes, such that the barrier sections pivot relative to each other; and said pivotable movement is limited by abutment between outer edges of the end face of the first connecting-region with the contact face of the second barrier section.

2. The barrier as claimed in claim 1, wherein in the second position, the first connecting region and the second connecting-region are engaged in an angled, nonlinearly aligned configuration.

3. The barrier as claimed in claim 1, wherein the first connecting-region includes at least one projecting portion, and at least on receiving portion at either end thereof.

4. The barrier as claimed in of claim 3, wherein the at least one projecting portion and the at least one receiving portion are integral with the body of the barrier section.

5. The barrier as claimed in claim 3, wherein the at least one projecting portion and the at least one receiving portion are made of substantially the same material as the barrier section.

6. The barrier as claimed in claim 3, wherein the at least one projecting portion and the at least one receiving portion complement each other in the form of at least one respective alternating protrusion and recess and thereby fit together.

7. The barrier as claimed in claim 3, wherein the at least one projecting portion is at least one protrusion.

8. The barrier as claimed in claim 7, wherein there is one protrusion, and the protrusion is substantially centrally positioned.

9. The barrier as claimed in claim 7, wherein there are three or more protrusions, and the protrusions are evenly spaced with respect to one another.

10. The barrier as claimed in claim 3, wherein the at least one receiving portion is at least one recess.

11. The barrier as claimed in claim 10, wherein the at least one recess is in the form of a notch.

12. The barrier as claimed in claim 10, wherein the dimensions of the recess are sufficient to receive the protrusion and provide enough space for a connection to be effected even when the respective sections are non-coplanar relative to each other along a horizontal axis.

13. The barrier as claimed in claim 3, wherein the inner and outer holes are orientated parallel to each other through at least one of the at least one projecting portion and the at least one receiving portion.

14. The barrier as claimed in claim 1, wherein the barrier sections are positioned at an angle of up to 30° with respect to each other.

15. The barrier as claimed in claim 1, wherein an angle between the barrier sections is between 7.5° to 15° from an aligned configuration.

16. The barrier as claimed in claim 1, wherein the at least one connecting-region is in the form of a projecting portion.

17. The barrier as claimed in claim 1, wherein the prongs of the connecting device comprise pins.

18. The barrier as claimed in claim 1, wherein the barrier sections are constructed from plastic.

19. The barrier as claimed in claim 1, wherein the barrier is constructed from metal.

20. The barrier as claimed in claim 1, wherein the barrier section has a hollow portion which can be filled with material to add weight to the barrier section.

21. A barrier constructed from two or more barriers as claimed in claim 1.

22. The barrier as claimed in claim 1, wherein the connecting device has at least two shafts aligned in the same plane, wherein the shafts are adapted to be received through the apertures.

23. The barrier as claimed in claim 22, wherein the connecting device is a U-shaped staple.

24. A method of constructing a vehicle impact barrier by the steps of:

(a) selecting two or more barrier sections as claimed in claim 1; and (b) connecting the barrier sections so that they are engaged to one another in either the first or second position, wherein steps (a) to (b) are repeated with a multiple number of barrier sections until the desired barrier length is achieved.

* * * * *